US010934979B2

(12) United States Patent
Van Nieuwstadt et al.

(10) Patent No.: US 10,934,979 B2
(45) Date of Patent: Mar. 2, 2021

(54) METHODS AND SYSTEM DIAGNOSING A VARIABLE GEOMETRY COMPRESSOR FOR AN INTERNAL COMBUSTION ENGINE

(71) Applicant: Ford Global Technologies, LLC, Dearborn, MI (US)

(72) Inventors: Michiel J. Van Nieuwstadt, Ann Arbor, MI (US); Devesh Upadhyay, Canton, MI (US); David R. Hanna, Troy, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 947 days.

(21) Appl. No.: 15/608,909

(22) Filed: May 30, 2017

(65) Prior Publication Data

US 2018/0347515 A1 Dec. 6, 2018

(51) Int. Cl.

| | |
|---|---|
| ***F02M 26/47*** | (2016.01) |
| ***F02M 26/02*** | (2016.01) |
| *F02M 26/20* | (2016.01) |
| *F02M 26/72* | (2016.01) |

(52) U.S. Cl.

CPC ..... *F02M 26/47* (2016.02); *F02M 26/02* (2016.02); *F02M 26/20* (2016.02); *F02M 26/72* (2016.02)

(58) Field of Classification Search

CPC ..... F02M 26/47; F02M 26/02; F02M 26/20; F02B 37/02; F02B 37/22; F02B 39/00; F02B 37/10; F02B 37/24; F02B 37/225; F02B 2037/122; F02B 2037/125; F04D 27/0253; F04D 29/464; F04D 29/284; F04D 29/287; F02D 41/0007

See application file for complete search history.

(56) References Cited

U.S. PATENT DOCUMENTS

| | | | | |
|---|---|---|---|---|
| 6,298,718 | B1 | 10/2001 | Wang | |
| 6,785,604 | B2 | 8/2004 | Jacobson | |
| 9,163,555 | B2 * | 10/2015 | McConville | F02B 37/164 |
| 9,528,430 | B2 | 12/2016 | Banker et al. | |
| 9,631,564 | B2 * | 4/2017 | Ossareh | F02D 41/0007 |
| 10,267,215 | B2 * | 4/2019 | Shiwa | F02B 37/16 |
| 2008/0209887 | A1 * | 9/2008 | Hanari | F02B 39/16 60/277 |
| 2009/0151354 | A1 * | 6/2009 | Dronzkowski | F02B 37/24 60/619 |
| 2009/0259386 | A1 * | 10/2009 | Eiraku | F02D 41/18 701/103 |
| 2010/0152992 | A1 * | 6/2010 | Burkhardt | F02D 41/1401 701/102 |
| 2015/0122234 | A1 * | 5/2015 | Tanaka | F02D 41/221 123/564 |
| 2015/0144114 | A1 * | 5/2015 | Tanaka | F02D 41/0007 123/564 |
| 2016/0215712 | A1 * | 7/2016 | Yokoyama | F01D 25/10 |

(Continued)

*Primary Examiner* — Phutthiwat Wongwian
*Assistant Examiner* — Arnold Castro
(74) *Attorney, Agent, or Firm* — Geoffrey Brumbaugh; McCoy Russell LLP

(57) ABSTRACT

Systems and methods for controlling and diagnosing air flow through a compressor without recirculating air flow through the compressor are presented. In one example, a position of an air flow control device located within a compressor housing is adjusted responsive to a request to diagnose flow through the compressor. The diagnostic may be performed while maintaining engine torque and speed.

17 Claims, 7 Drawing Sheets

(56) References Cited

U.S. PATENT DOCUMENTS

| | | | | |
|---|---|---|---|---|
| 2017/0138278 | A1* | 5/2017 | Xiao | F02D 41/0005 |
| 2017/0145907 | A1* | 5/2017 | Nishio | F02B 39/16 |
| 2017/0292872 | A1* | 10/2017 | Zywiak | G01F 1/44 |

* cited by examiner

162

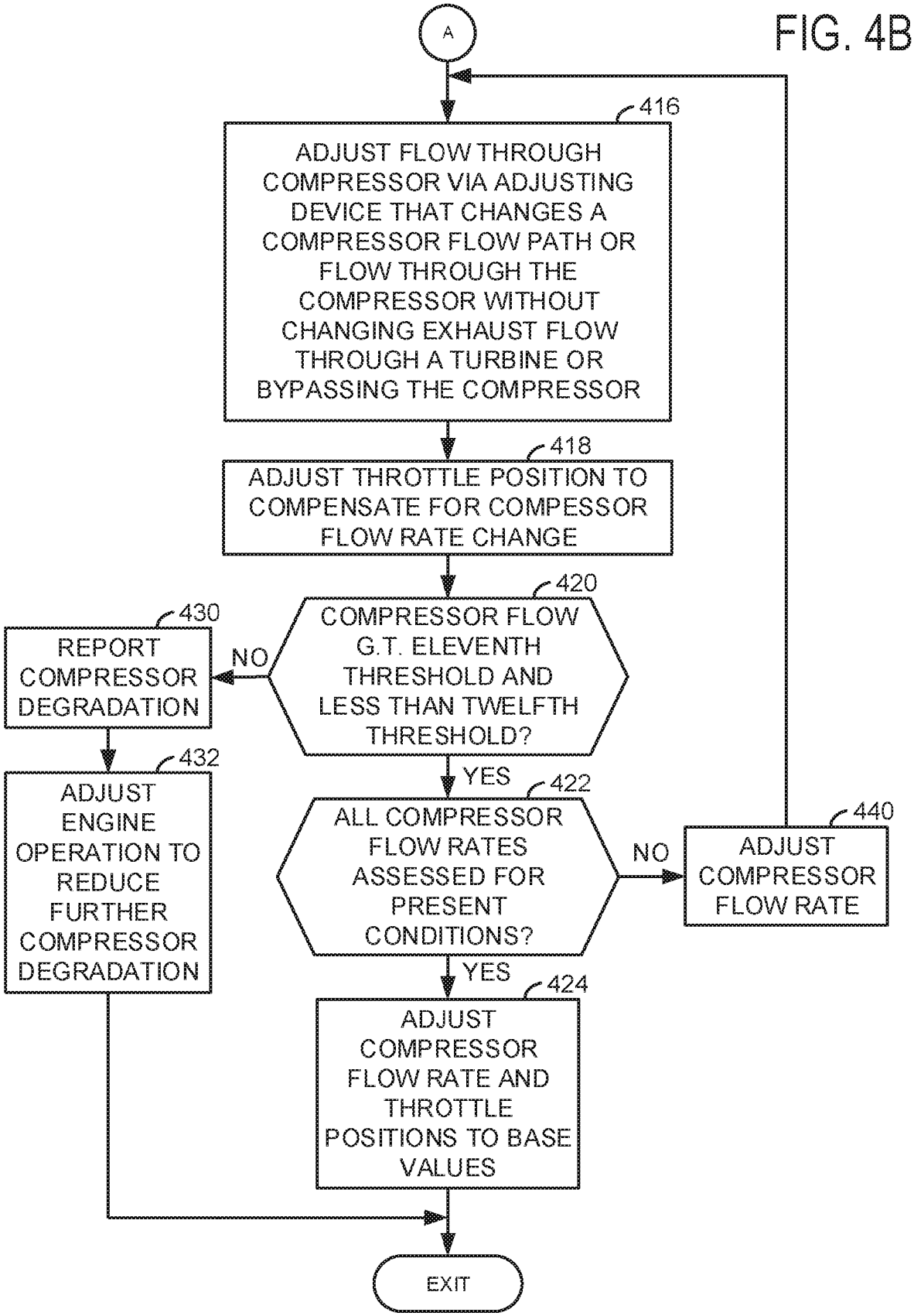
FIG. 4B
A
416
ADJUST FLOW THROUGH COMPRESSOR VIA ADJUSTING DEVICE THAT CHANGES A COMPRESSOR FLOW PATH OR FLOW THROUGH THE COMPRESSOR WITHOUT CHANGING EXHAUST FLOW THROUGH A TURBINE OR BYPASSING THE COMPRESSOR
418
ADJUST THROTTLE POSITION TO COMPENSATE FOR COMPESSOR FLOW RATE CHANGE
420
COMPRESSOR FLOW G.T. ELEVENTH THRESHOLD AND LESS THAN TWELFTH THRESHOLD?
NO
430
REPORT COMPRESSOR DEGRADATION
432
ADJUST ENGINE OPERATION TO REDUCE FURTHER COMPRESSOR DEGRADATION
YES
422
ALL COMPRESSOR FLOW RATES ASSESSED FOR PRESENT CONDITIONS?
NO
440
ADJUST COMPRESSOR FLOW RATE
YES
424
ADJUST COMPRESSOR FLOW RATE AND THROTTLE POSITIONS TO BASE VALUES
EXIT

METHODS AND SYSTEM DIAGNOSING A VARIABLE GEOMETRY COMPRESSOR FOR AN INTERNAL COMBUSTION ENGINE

FIELD

The present description relates to methods and a system for diagnosing operation of a variable geometry compressor for an internal combustion engine. The methods and systems may be particularly useful compressors that include a device for adjusting geometry of a flow passage of a compressor.

BACKGROUND AND SUMMARY

A turbocharger may include a device for adjusting air flow through the turbocharger's compressor. In particular, the turbocharger may include a waste gate or variable vanes that regulate flow of exhaust gas through the turbocharger's turbine so that a speed of the turbocharger's compressor may be increased or decreased, thereby adjusting compressor flow. Adjusting turbocharger turbine speed to control air flow through the turbocharger's compressor may be effective, but the turbine's speed cannot be instantaneously changed due to compressor fan inertia and turbine fan inertia. Consequently, air flow through the compressor may not follow a desired compressor flow as close as may be desired.

One way of adjusting air flow through the compressor is to recirculate a portion of air flow from the outlet of the compressor to the inlet of the compressor so as to reduce total air flow through the compressor. However, recirculating air flow through a compressor requires a bypass passage external to the compressor and an actuator to adjust flow through the bypass passage. Further, the bypass passage may change air flow dynamics through the air compressor so that engine noise may increase, and the compressor bypass passage and bypass valve may make it difficult to determine if the compressor is working properly or if there may be an issue with the bypass passage and/or the bypass valve. Therefore, it would be desirable to provide a way of controlling air flow through a compressor and diagnosing whether or not air flow through the compressor adjusts as desired.

The inventors herein have recognized the above-mentioned issues and have developed an engine operating method, comprising: adjusting air flowing through a compressor and into an engine without recirculating at least a portion of the air flowing through the compressor from an outlet of the compressor to an inlet of the compressor in response to a request to diagnose flow through the compressor, the air flowing through the compressor adjusted via a flow control device in an air flow path of the engine.

By adjusting air flow through a compressor via a flow control device in an air flow path of an engine in response to a request to diagnose flow through the compressor, it may be possible to diagnose compressor operation without having to bypass at least a portion of flow through a compressor bypass loop. In addition, the engine may be maintained at a constant speed and load while the compressor is being diagnosed by further adjusting a position of a throttle responsive to the request to diagnose flow through the compressor. In this way, it may be possible to diagnose a compressor and a compressor flow control device that directly controls air flow through the compressor.

The present description may provide several advantages. In particular, the approach may provide improve diagnostics of compressor flow control devices. Additionally, the approach may provide a way of perturbing an air flow actuator to diagnose compressor flow without disturbing vehicle passengers. Further, the approach may be applied to gasoline or diesel engines that include a turbocharger or crankshaft driven supercharger.

The above advantages and other advantages, and features of the present description will be readily apparent from the following Detailed Description when taken alone or in connection with the accompanying drawings.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

BRIEF DESCRIPTION OF THE DRAWINGS

The advantages described herein will be more fully understood by reading an example of an embodiment, referred to herein as the Detailed Description, when taken alone or with reference to the drawings, where:

FIGS. 4A-4C shows an example method for diagnosing a variable flow rate compressor.

DETAILED DESCRIPTION

Figure 1:
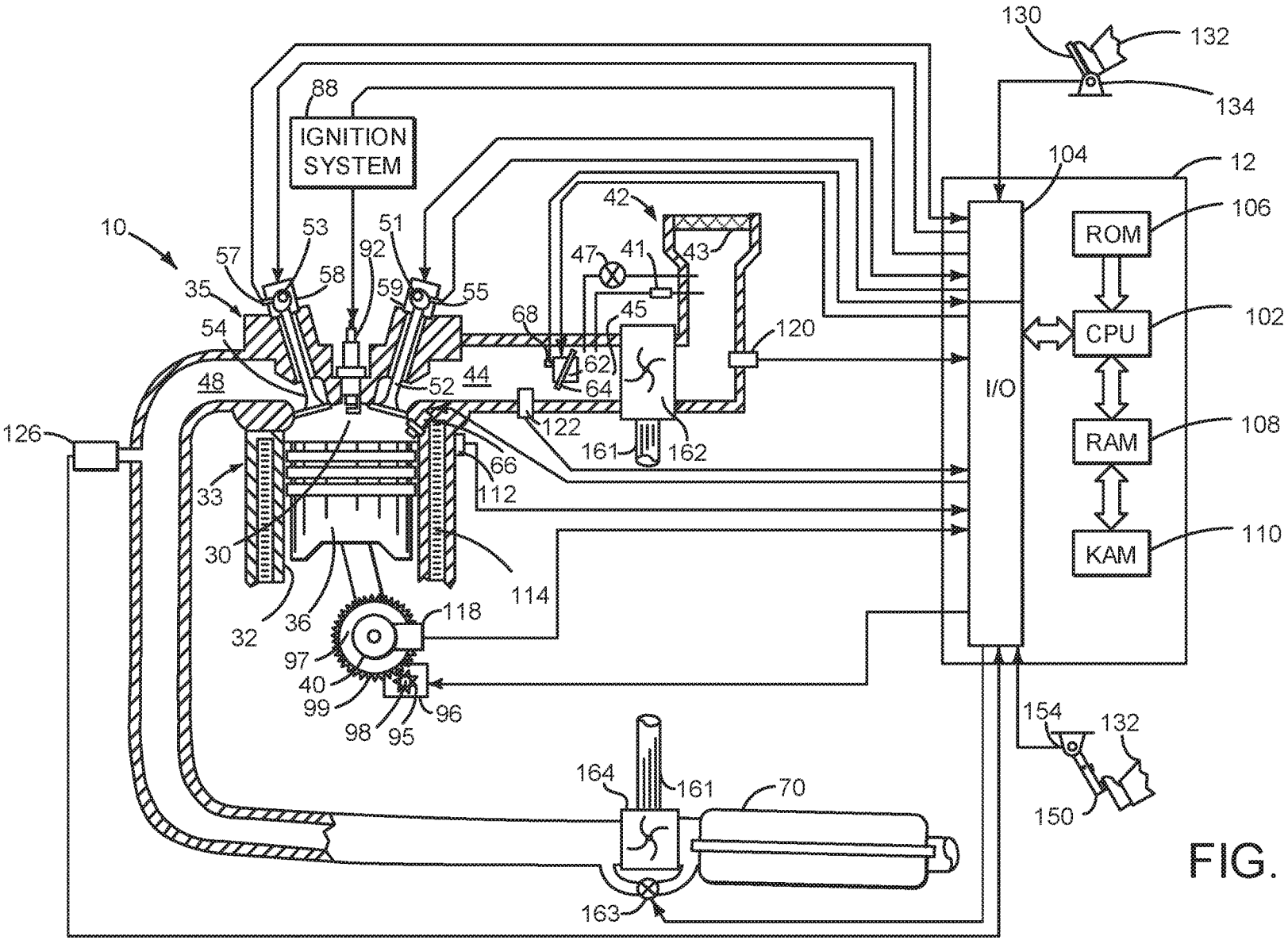
FIG. 1 is a schematic diagram of an engine including a turbocharger.
Figure 2B:
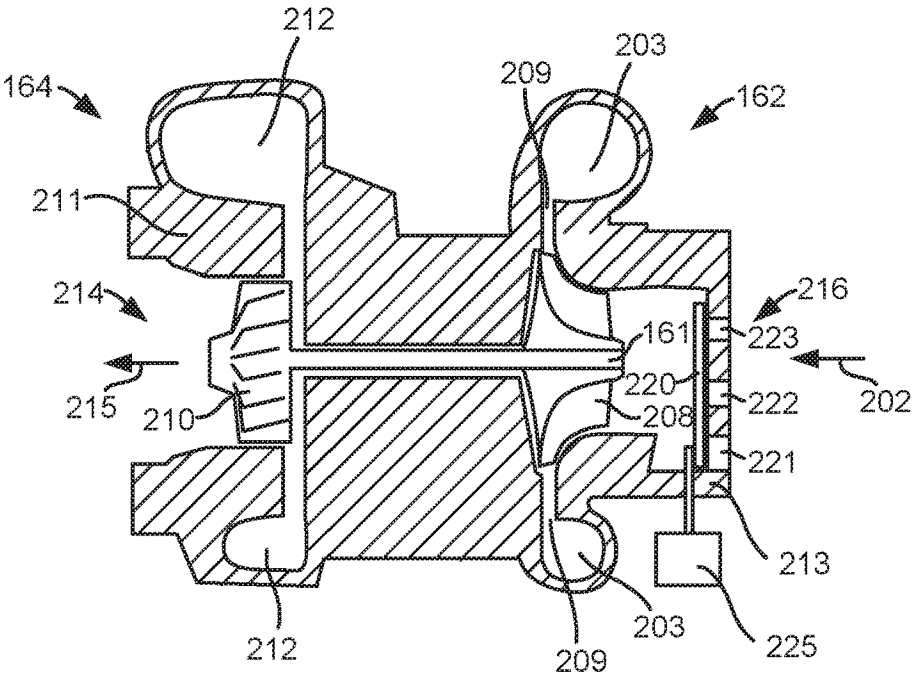
FIGS. 2A-2C show cross sections of example turbocharger compressors.
Figure 2A:
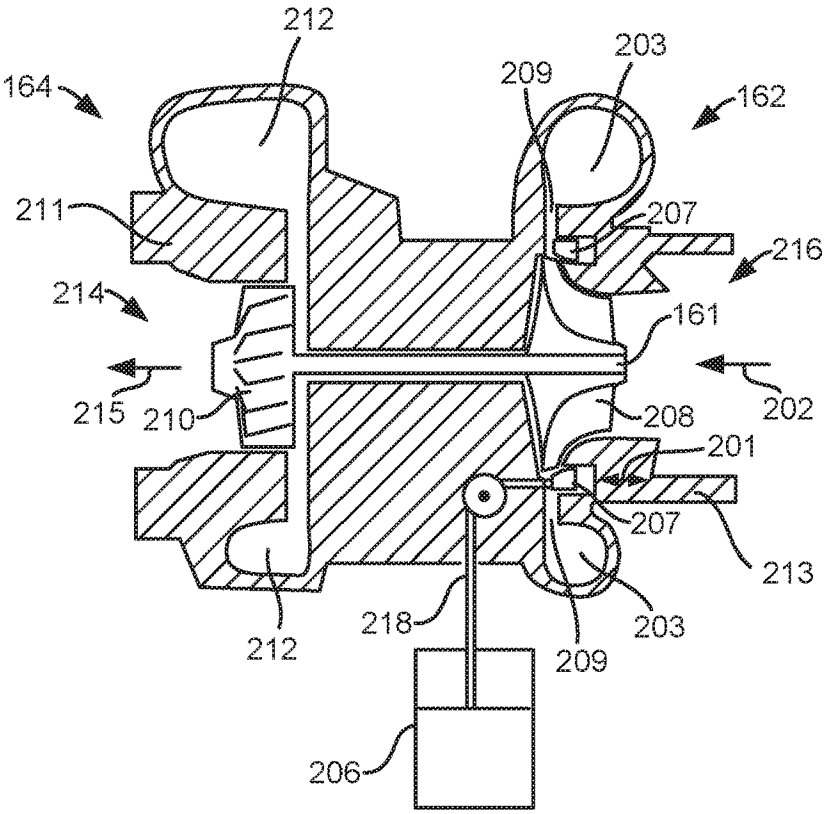
Figure 2C:
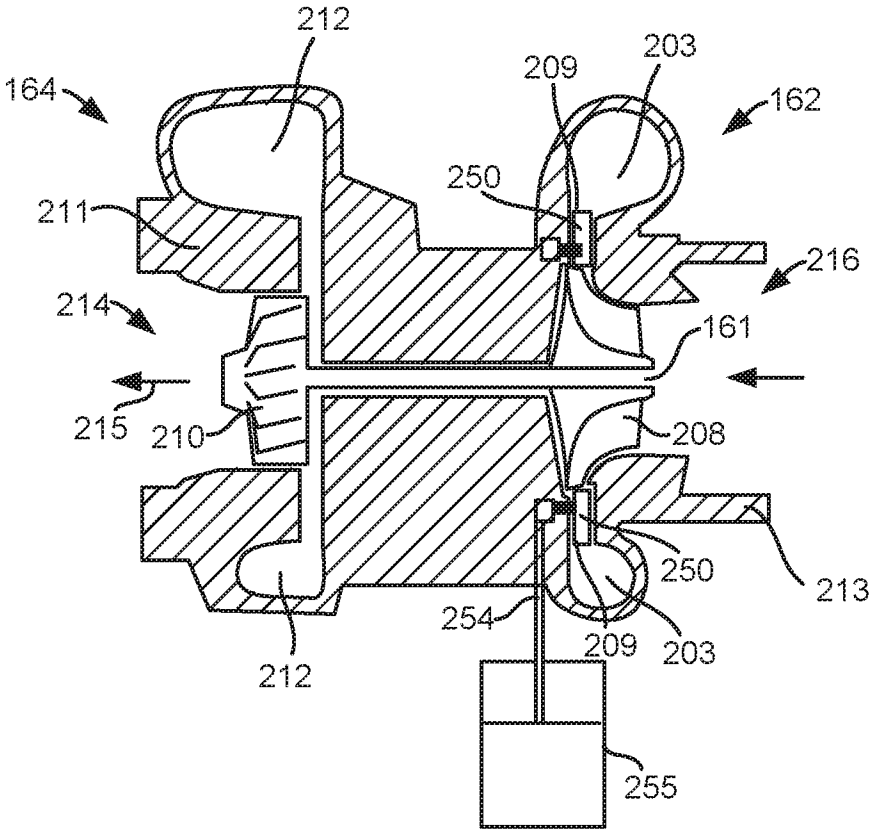

The present description is related to providing diagnosing operation of an engine that includes a variable flow compressor. The compressor may be included in a turbocharger or a crankshaft driven supercharger. An example turbocharged engine is shown in FIG. 1. Three different turbochargers and their compressors are shown in FIGS. 2A-2C. Air flow through the compressors may be adjusted via a compressor flow control device located within the compressor housing. The compressor may be diagnosed via the sequence shown in FIG. 3 according to the method of FIGS. 4A-4C.

Referring to FIG. 1, internal combustion engine 10, comprising a plurality of cylinders, one cylinder of which is shown in FIG. 1, is controlled by electronic engine controller 12. Engine 10 is comprised of cylinder head 35 and block 33, which include combustion chamber 30 and cylinder walls 32. Piston 36 is positioned therein and reciprocates via a connection to crankshaft 40. Flywheel 97 and ring gear 99 are coupled to crankshaft 40. Starter 96 (e.g., low voltage (operated with less than 30 volts) electric machine) includes pinion shaft 98 and pinion gear 95. Pinion shaft 98 may selectively advance pinion gear 95 to engage ring gear 99. Starter 96 may be directly mounted to the front of the engine or the rear of the engine. In some examples, starter 96 may selectively supply torque to crankshaft 40 via a belt or chain. In one example, starter 96 is in a base state when not engaged to the engine crankshaft. Combustion chamber 30 is shown communicating with intake manifold 44 and exhaust manifold 48 via respective intake valve 52 and exhaust valve 54. Each intake and exhaust valve may be operated by an intake cam 51 and an exhaust cam 53. The position of intake cam 51 may be determined by intake cam sensor 55. The position of exhaust cam 53 may be determined by exhaust cam sensor 57. Intake valve 52 may be selectively activated and deactivated by valve activation device 59. Exhaust valve 54 may be selectively activated and deactivated by valve activation device 58. Valve activation devices 58 and 59 may be electro-mechanical devices.

Fuel injector 66 is shown positioned to inject fuel directly into cylinder 30, which is known to those skilled in the art as direct injection. Fuel injector 66 delivers liquid fuel in proportion to the pulse width from controller 12. Fuel is delivered to fuel injector 66 by a fuel system (not shown) including a fuel tank, fuel pump, and fuel rail (not shown). In one example, a high pressure, dual stage, fuel system may be used to generate higher fuel pressures.

In addition, intake manifold 44 is shown communicating with turbocharger compressor 162 and engine air intake 42. In other examples, compressor 162 may be a supercharger compressor. Shaft 161 mechanically couples turbocharger turbine 164 to turbocharger compressor 162. Optional electronic throttle 62 adjusts a position of throttle plate 64 to control air flow from compressor 162 to intake manifold 44. Pressure in boost chamber 45 may be referred to a throttle inlet pressure since the inlet of throttle 62 is within boost chamber 45. The throttle outlet is in intake manifold 44. In some examples, throttle 62 and throttle plate 64 may be positioned between intake valve 52 and intake manifold 44 such that throttle 62 is a port throttle. A compressor recirculation valve 47 may be opened to recirculate compressor flow from the compressor inlet to the compressor outlet. Alternatively, compressor recirculation valve 47 may be closed to prevent recirculation of air around compressor 162. Waste gate 163 may be adjusted via controller 12 to allow exhaust gases to selectively bypass turbine 164 to control the speed of compressor 162. Pressure across compressor 162 may be determined via pressure sensor 41. Air filter 43 cleans air entering engine air intake 42. Throttle 62 is positioned downstream of compressor 162 in the direction of air flow into engine 10.

Distributorless ignition system 88 provides an ignition spark to combustion chamber 30 via spark plug 92 in response to controller 12. Universal Exhaust Gas Oxygen (UEGO) sensor 126 is shown coupled to exhaust manifold 48 upstream of catalytic converter 70. Alternatively, a two-state exhaust gas oxygen sensor may be substituted for UEGO sensor 126.

Converter 70 can include multiple catalyst bricks, in one example. In another example, multiple emission control devices, each with multiple bricks, can be used. Converter 70 can be a three-way type catalyst in one example.

Controller 12 is shown in FIG. 1 as a conventional microcomputer including: microprocessor unit 102, input/output ports 104, read-only memory 106 (e.g., non-transitory memory), random access memory 108, keep alive memory 110, and a conventional data bus. Controller 12 is shown receiving various signals from sensors coupled to engine 10, in addition to those signals previously discussed, including: engine coolant temperature (ECT) from temperature sensor 112 coupled to cooling sleeve 114; a position sensor 134 coupled to an accelerator pedal 130 for sensing force applied by human foot 132; a position sensor 154 coupled to brake pedal 150 for sensing force applied by human foot 132, a measurement of engine manifold pressure (MAP) from pressure sensor 122 coupled to intake manifold 44; an engine position sensor from a Hall effect sensor 118 sensing crankshaft 40 position; a measurement of air mass entering the engine from sensor 120; and a measurement of throttle position from sensor 68. Barometric pressure may also be sensed (sensor not shown) for processing by controller 12. In a preferred aspect of the present description, engine position sensor 118 produces a predetermined number of equally spaced pulses every revolution of the crankshaft from which engine speed (RPM) can be determined.

During operation, each cylinder within engine 10 typically undergoes a four stroke cycle: the cycle includes the intake stroke, compression stroke, expansion stroke, and exhaust stroke. During the intake stroke, generally, the exhaust valve 54 closes and intake valve 52 opens. Air is introduced into combustion chamber 30 via intake manifold 44, and piston 36 moves to the bottom of the cylinder so as to increase the volume within combustion chamber 30. The position at which piston 36 is near the bottom of the cylinder and at the end of its stroke (e.g. when combustion chamber 30 is at its largest volume) is typically referred to by those of skill in the art as bottom dead center (BDC).

During the compression stroke, intake valve 52 and exhaust valve 54 are closed. Piston 36 moves toward the cylinder head so as to compress the air within combustion chamber 30. The point at which piston 36 is at the end of its stroke and closest to the cylinder head (e.g. when combustion chamber 30 is at its smallest volume) is typically referred to by those of skill in the art as top dead center (TDC). In a process hereinafter referred to as injection, fuel is introduced into the combustion chamber. In a process hereinafter referred to as ignition, the injected fuel is ignited by known ignition means such as spark plug 92, resulting in combustion.

During the expansion stroke, the expanding gases push piston 36 back to BDC. Crankshaft 40 converts piston movement into a rotational torque of the rotary shaft. Finally, during the exhaust stroke, the exhaust valve 54 opens to release the combusted air-fuel mixture to exhaust manifold 48 and the piston returns to TDC. Note that the above is shown merely as an example, and that intake and exhaust valve opening and/or closing timings may vary, such as to provide positive or negative valve overlap, late intake valve closing, or various other examples.

FIG. 2A is a cross section of a first example turbocharger that includes a variable geometry compressor. The turbocharger includes a turbine 164, compressor 162, and shaft 161 as shown in FIG. 1. Exhaust gas from engine 10 flows into exhaust passage 212 and encircles turbine wheel 210. The exhaust gases pass by turbine wheel and expand causing turbine wheel 210 to rotate, which rotates shaft 161 and compressor impeller 208. The engine exhaust gases exit the exhaust passage outlet 214 in the direction indicated by arrow 215. Turbine housing 211 encloses and supports turbine wheel 210.

Filtered air enters compressor 162 via compressor inlet 216 and flows in the direction of arrow 202. Compressor impeller 208 rotates and compresses air entering inlet 216. Compressor impeller 208 directs compressed air to compressor nozzle 209. Compressor nozzle 209 is a variable nozzle that varies the cross-sectional area of the nozzle to vary flow through the nozzle and it is of an annular shape. Nozzle 209 regulates air flow from compressor impeller 208 to boost air outlet 203. Cross-sectional area of nozzle 209 may be increased or decreased via adjusting a position of flow control sleeve 207, which is of annular shape. Flow control sleeve 207 may move in the direction shown by arrow 201. The position of flow control sleeve 207 may be adjusted via actuator 206, which may be coupled to flow control sleeve via linkage 218. Compressor flow control actuator 206 may be hydraulically, electrically, or pneumatically operated. Moving flow control sleeve 207 in a left direction relative to arrow 201 closes nozzle 209 and may reduce air flow through the compressor. Moving flow control sleeve 207 in a right direction relative to arrow 201 opens nozzle 209 and may increase air flow through the compressor. Thus, flow control sleeve 207 may control (e.g., increase or decrease) air flowing directly from the compressor inlet 216 to the compressor boost air outlet 203 without recirculating air around compressor impeller 208. Flow control sleeve 207 and nozzle 209 are located within compressor housing 213.

Referring now to FIG. 2B, a cross section of a second example turbocharger that includes a variable geometry compressor is shown. The turbocharger includes a turbine 164, compressor 162, and shaft 161 as shown in FIG. 1. Exhaust gas from engine 10 flows into exhaust passage 212 and encircles turbine wheel 210. The exhaust gases pass by turbine wheel and expand causing turbine wheel 210 to rotate, which rotates shaft 161 and compressor impeller 208. The engine exhaust gases exit the exhaust passage outlet 214 in the direction indicated by arrow 215. Turbine housing 211 encloses and supports turbine wheel 210.

Filtered air enters compressor 162 via compressor inlet 216 and flows in the direction of arrow 202. Air enters compressor housing 213 via a plurality of inlet passages 221, 222, and 223, in compressor housing 213. Compressor casing flow control valve 220 adjusts an opening area of inlet passages 221, 222, and 223 to control air flow into compressor 162. A position of casing flow control valve 220 is adjustable via compressor casing actuator 225, which may be hydraulically, electrically, or pneumatically operated. Compressor casing flow control valve 220 may be a rotary valve, gate valve, or other known type of flow control valve. Compressor impeller 208 rotates and compresses air entering inlet 216. Compressor impeller 208 directs compressed air to compressor nozzle 209, and compressed air exits compressor 162 at compressor boost air outlet 203. Thus, compressor casing flow control valve 220 may control (e.g., increase or decrease) air flowing into the compressor inlet 216 so as to control air flow through compressor 162 and the compressor boost air outlet 203 without recirculating air around compressor impeller 208. Compressor casing flow control valve 220 and inlet passages 221, 222, and 223 are located within compressor housing 213.

Referring now to FIG. 2C, a cross section of a third example turbocharger that includes a variable geometry compressor is shown. The turbocharger includes a turbine 164, compressor 162, and shaft 161 as shown in FIG. 1. Exhaust gas from engine 10 flows into exhaust passage 212 and encircles turbine wheel 210. The exhaust gases pass by turbine wheel and expand causing turbine wheel 210 to rotate, which rotates shaft 161 and compressor impeller 208. The engine exhaust gases exit the exhaust passage outlet 214 in the direction indicated by arrow 215. Turbine housing 211 encloses and supports turbine wheel 210.

Filtered air enters compressor 162 via compressor inlet 216 and flows in the direction of arrow 202. Compressor impeller 208 rotates and compresses air entering inlet 216. Compressor impeller 208 directs compressed air to compressor nozzle 209. Compressor nozzle 209 is a variable nozzle that varies the cross-sectional area of the nozzle to vary flow through the nozzle and it is of an annular shape. Nozzle 209 regulates air flow from compressor impeller 208 to boost air outlet 203. The nozzle includes a plurality of circumferentially spaced vanes 250. Each vane 250 is held in place via a pin (not shown) that is rotatable. Each vane 250 may rotate so that its accompanying vane can rotate about the pin, thereby adjusting an angle of the vane. Each pin includes a linkage (not shown) that engages a ring (not shown) that is rotatable about its axis. The vanes 250 rotate when the ring is rotated via actuator 255. The angles of the vanes change as the vanes rotate to vary a cross-sectional area of nozzle 209. Compressor flow control actuator 255 may be hydraulically, electrically, or pneumatically operated. Thus, flow control vanes 250 may control (e.g., increase or decrease) air flowing directly from the compressor inlet 216 to the compressor boost air outlet 203 without recirculating air around compressor impeller 208. Vanes 250 and nozzle 209 are located within compressor housing 213.

Thus, the system of FIGS. 1-2C provides for a system, comprising: an engine; a turbocharger coupled to the engine and including a compressor, a turbine, and an air flow control device within a compressor housing; a controller including instructions stored in non-transitory memory to adjust the air flow control device in response to a request to diagnose air flow through the compressor without recirculating air through the compressor. The system includes where the air flow control device is a vane, and further comprising additional instructions to adjust the air flow control device in further response to change in engine air flow greater than a threshold. The system includes where the air flow control device is an air flow control sleeve, and further comprising additional instructions to adjust the air flow control device in response to a change in engine speed greater than a threshold. The system includes where the air flow control device is a compressor casing flow control valve, and further comprising additional instructions to adjust the air flow control device in response to engine speed greater than a first threshold and engine speed less than a second threshold. The system further comprises a throttle located in an air passage of the engine at a location downstream of the compressor. The system further comprises instructions to adjust a position of throttle responsive to the request to diagnose air flow through the compressor.

Figure 3:
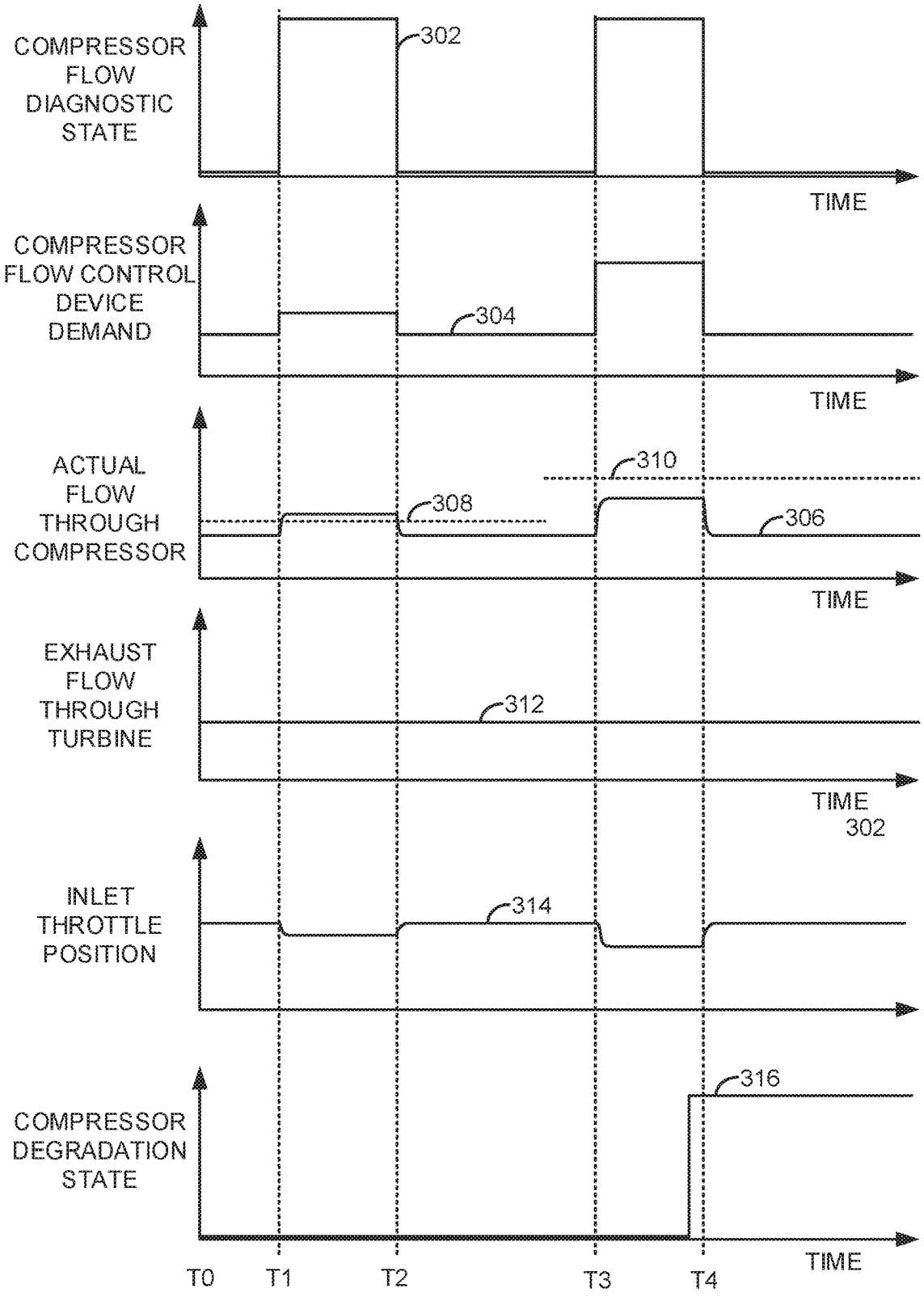
FIG. 3 is a prophetic operating sequence for diagnosing a compressor.

Referring now to FIG. 3, a prophetic operating sequence for diagnosing a compressor is shown. The sequence of FIG. 3 may be provided by the method of FIGS. 4A-4C in cooperation with the system of FIGS. 1-2C. The sequence is performed for an engine operating at a constant speed and load throughout the sequence.

The first plot from the top of FIG. 3 is a plot of compressor flow diagnostic state versus time. The vertical axis represents compressor diagnostic state and a compressor diagnostic is being performed when the trace 302 is at a higher level near the vertical axis arrow. A compressor diagnostic is not being performed when trace 302 is near the horizontal axis. The horizontal axis represents time and time increases from the left side of the figure to the right side of the figure.

The second plot from the top of FIG. 3 is a plot of a compressor flow control device flow demand versus time. The compressor flow control device flow demand adjusts flow through the compressor. The compressor flow device may be a sleeve, vanes, or a compressor flow control valve as shown in FIGS. 2A-2C. The compressor flow control device flow demand is indicated by trace 304 and it increases in the direction of the vertical axis arrow. The horizontal axis represents time and time increases from the left side of the figure to the right side of the figure.

The third plot from the top of FIG. 3 is a plot of actual flow through the compressor versus time. The actual compressor flow increases in the direction of the vertical axis arrow and it is represented by trace 306. Horizontal line 308 represents a threshold compressor flow that is compared to the actual flow through the compressor between times T1 and T2. Horizontal line 310 represents a threshold compressor flow that is compared to the actual flow through the compressor between times T3 and T4. The horizontal axis represents time and time increases from the left side of the figure to the right side of the figure.

The fourth plot from the top of FIG. 3 is a plot of exhaust flow through a turbine that drives the compressor. The exhaust flow rate is represented by trace 312. The exhaust flow rate increases in the direction of the vertical axis arrow. The horizontal axis represents time and time increases from the left side of the figure to the right side of the figure.

The fifth plot from the top of FIG. 3 is a plot of engine intake throttle (e.g., 62 of FIG. 1) position versus time. The intake throttle position is represented by trace 314. The intake throttle opening amount increases in the direction of the vertical axis arrow. The intake throttle is fully closed when trace 314 is at a level of the horizontal axis. The horizontal axis represents time and time increases from the left side of the figure to the right side of the figure.

The sixth plot from the top of FIG. 3 is a plot of compressor degradation state versus time. The vertical axis represents compressor degradation and the compressor is degraded when the compressor degradation state is at a higher level near the vertical axis arrow. The compressor is not degraded when the compressor degradation state is at a lower level near the horizontal axis. Trace 316 represents the compressor degradation states. The horizontal axis represents time and time increases from the left side of the figure to the right side of the figure.

At time T0, the compressor is not degraded and the compressor is not undergoing a compressor diagnostic. The compressor flow control device is commanded to a lower level and actual flow through the compressor is at a lower level. The exhaust flow rate through the turbine driving the compressor is at a lower middle level. The throttle is positioned to a middle level.

At time T1, a compressor flow diagnostic is activated as indicated by the compressor flow diagnostic state transitioning from a lower level to a higher level. The compressor flow control device is commanded to increase flow through the compressor as indicated by the compressor flow control device demand increasing. The actual air flow through the compressor increases to a level greater than threshold 308 shortly after time T1. The exhaust flow through the turbine remains constant and the throttle inlet position is reduced to partially close the throttle so that the air flow rate to the engine remains constant even though the compressor flow rate is increased. The compressor degradation state is not asserted to indicate that air flow through the compressor is at an expected level.

At time T2, the compressor flow diagnostic is deactivated as indicated by the compressor flow diagnostic state transitioning from a higher level to a lower level. The compressor flow control device is commanded to decrease flow through the compressor as indicated by the compressor flow control device demand decreasing. The actual air flow through the compressor decreases to a level less than threshold 308 shortly after time T2. The exhaust flow through the turbine remains constant and the throttle inlet position is increased to partially open the throttle so that the air flow rate to the engine remains constant even though the compressor flow rate is decreased. The compressor degradation state is not asserted to indicate that air flow through the compressor is at an expected level. Thus, the compressor flow diagnostic for a first flow rate through the compressor is complete and the compressor performs as is desired.

At time T3, a second compressor flow diagnostic is activated as indicated by the compressor flow diagnostic state transitioning from a lower level to a higher level, the higher level greater than the higher level at time T1. The compressor flow control device is commanded to increase flow through the compressor as indicated by the compressor flow control device demand increasing. The actual air flow through the compressor increases, but to a level that is less than threshold 310 shortly after time T3. The exhaust flow through the turbine remains constant and the throttle inlet position is reduced to partially close the throttle so that the air flow rate to the engine remains constant even though the compressor flow rate is increased. The compressor degradation state is not initially asserted to indicate that air flow through the compressor is at an expected level. However, as time approaches T2, the compressor degradation state is asserted to indicate compressor degradation.

At time T4, the compressor flow diagnostic is deactivated as indicated by the compressor flow diagnostic state transitioning from a higher level to a lower level. The compressor flow control device is commanded to decrease flow through the compressor as indicated by the compressor flow control device demand decreasing. The actual air flow through the compressor decreases to a level less than threshold 310 shortly after time T4. The exhaust flow through the turbine remains constant and the throttle inlet position is increased to partially open the throttle so that the air flow rate to the engine remains constant even though the compressor flow rate is decreased. The compressor degradation state is remains asserted to indicate that air flow through the compressor was not at an expected level. Thus, the compressor flow diagnostic for a second flow rate through the compressor is complete and the compressor does not perform as is desired, so compressor degradation is indicated. Actions may be taken when compressor degradation is indicated to mitigate compressor degradation. For example, engine speed and load may be limited to less than threshold values. Further, exhaust flow through the turbine may be limited to reduce the possibility of further compressor degradation.

Figure 4A:
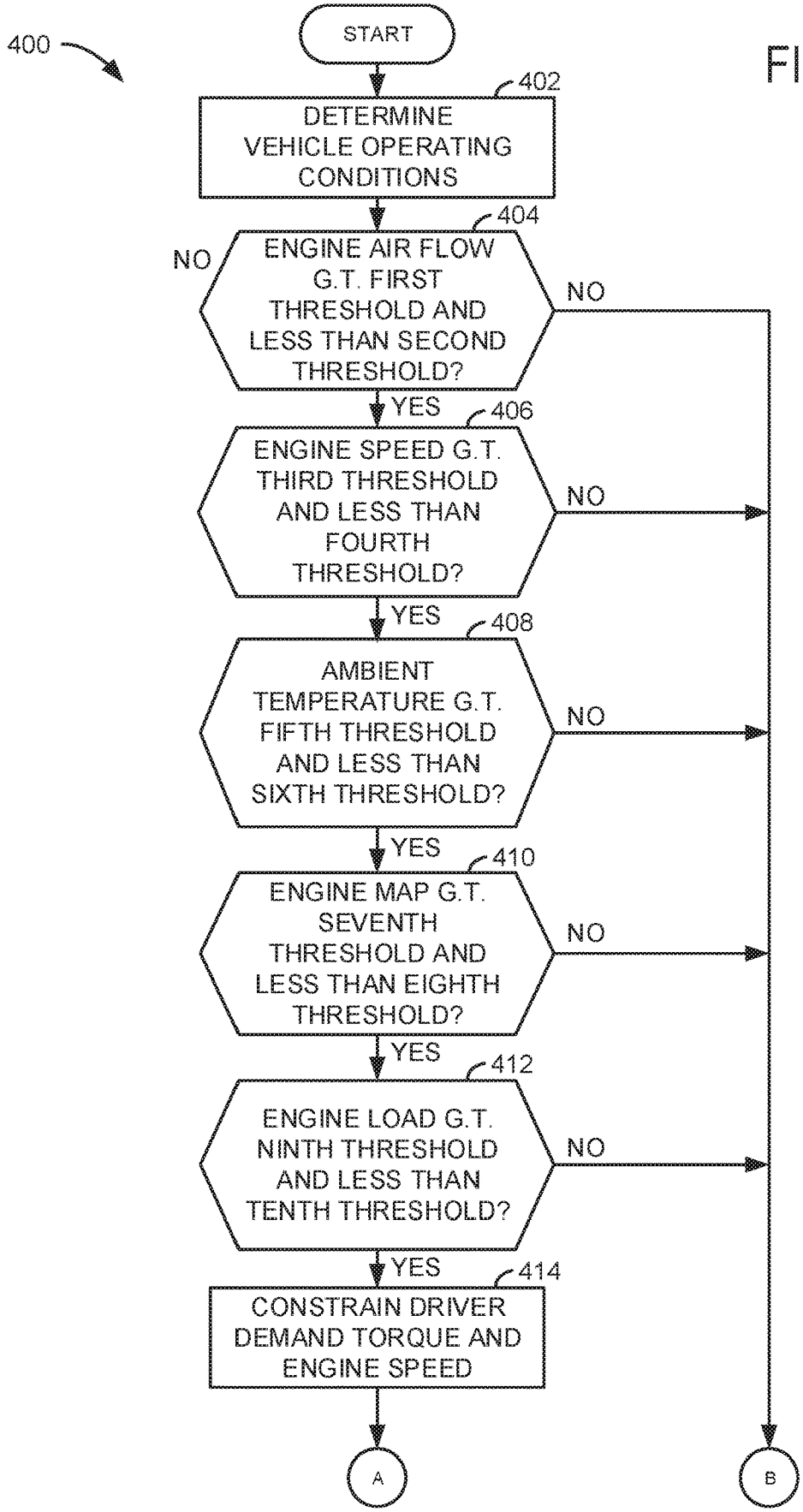
Figure 4C:
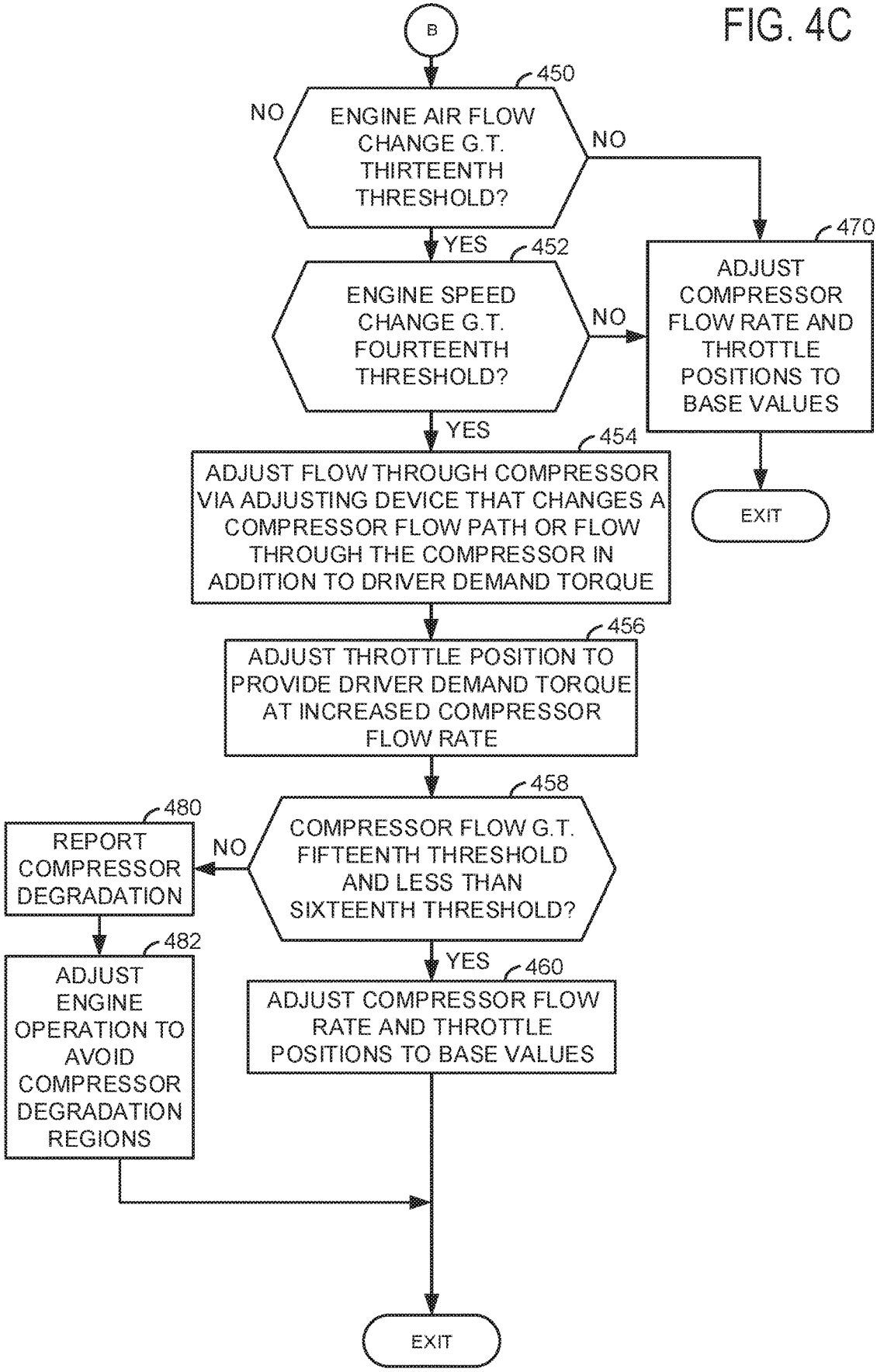

Referring now to FIGS. 4A-4C, an example flow chart for a method for diagnosing a compressor of an engine is shown. The method of FIGS. 4A-4C may be incorporated into and may cooperate with the system of FIGS. 1-2C. Further, at least portions of the method of FIGS. 4A-4C may be incorporated as executable instructions stored in non-transitory memory while other portions of the method may be performed via a controller transforming operating states of devices and actuators in the physical world.

At 402, method 400 determines vehicle operating conditions. Vehicle operating conditions may include but are not limited to vehicle speed, engine air flow amount, ambient temperature, engine intake manifold absolute pressure (MAP), engine load, and driver demand torque. Method 400 may determine the above conditions via sensors and actuators shown in FIG. 1. Method 400 proceeds to 404.

At 404, method 400 judges if engine air flow or the flow rate of air into the engine is greater than a first threshold and less than a second threshold. The thresholds may be predetermined empirically and stored in controller memory. If method 400 judges that the engine air flow rate is greater than the first threshold and less than the second threshold, the answer is yes and method 400 proceeds to 406. Otherwise, the answer is no and method 400 proceeds to 450.

At 406, method 400 judges if engine speed is greater than a third threshold and less than a fourth threshold. The thresholds may be predetermined empirically and stored in controller memory. If method 400 judges that the engine speed is greater than the third threshold and less than the fourth threshold, the answer is yes and method 400 proceeds to 408. Otherwise, the answer is no and method 400 proceeds to 450.

At 408, method 400 judges if ambient air temperature is greater than a fifth threshold and less than a sixth threshold. The thresholds may be predetermined empirically and stored in controller memory. If method 400 judges that the engine air flow rate is greater than the fifth threshold and less than the sixth threshold, the answer is yes and method 400 proceeds to 410. Otherwise, the answer is no and method 400 proceeds to 450.

At 410, method 400 judges if engine MAP is greater than a seventh threshold and less than an eighth threshold. The thresholds may be predetermined empirically and stored in controller memory. If method 400 judges that the engine MAP is greater than the seventh threshold and less than the eighth threshold, the answer is yes and method 400 proceeds to 412. Otherwise, the answer is no and method 400 proceeds to 450.

At 412, method 400 judges if engine load is greater than a ninth threshold and less than a tenth threshold. The thresholds may be predetermined empirically and stored in controller memory. If method 400 judges that the engine load is greater than the ninth threshold and less than the tenth threshold, the answer is yes and method 400 proceeds to 414. Otherwise, the answer is no and method 400 proceeds to 450.

At 414, method 400 has met a set of preconditions for diagnosing engine compressor operation. Method 400 then constrains driver demand torque (e.g., torque requested by a human driver via an accelerator pedal) to less than a threshold value. For example, method 400 may constrain driver demand torque to be less than 50% of the available driver demand torque. However, in some examples, if accelerator pedal position exceeds a threshold, method 400 may increase driver demand torque to match accelerator pedal position and suspend the engine compressor diagnostic. Method 400 proceeds to 416 after constraining driver demand torque.

At 416, method 400 adjusts flow through the compressor via a flow control device. The flow control device may be within the compressor and it adjusts flow through the compressor without recirculating air from the compressor outlet to the compressor inlet. However, in some examples, a portion of air may be recirculated from the compressor inlet to the compressor outlet while performing the diagnostic. The flow control devices may include the devices of FIGS. 2A-2C and other known compressor flow adjustment devices. The compressor flow is adjusted without adjusting exhaust flow through the turbine or a speed that the compressor wheel is spinning. The compressor flow rate may be adjusted to a plurality of different flow rates via adjusting a position or state of the compressor flow control device. Method 400 proceeds to 418 after commanding an adjustment to air flowing through the compressor.

At 418, method 400 adjusts a position of an engine throttle in response to the air compressor flow diagnostic request and the amount of increase in the commanded air flow through the compressor. The throttle position is adjusted to substantially maintain engine air flow (e.g., vary by less than 15%). For example, if the compressor flow rate is increased, the throttle may be partially closed to maintain engine air flow. The throttle position may be adjusted responsive to the pressure ratio across the throttle to substantially maintain engine air flow so that engine speed and torque are substantially maintained (e.g., vary by less than 15%). Method 400 proceeds to 420.

At 420, method 400 judges if air flow through the compressor is greater than an eleventh threshold and less than a twelfth threshold. The air flow through the compressor may be determined via an air flow sensor or a pressure sensor. If method 400 judges that air flow through the compressor is greater than an eleventh threshold and less than a twelfth threshold, the answer is yes and method 400 proceeds to 422. Otherwise, the answer is no and method 400 proceeds to 430.

At 422, method 400 judges if a desired number of air flow rates through the compressor for present conditions have been assessed. For example, it may be desirable to adjust air flow through the compressor to five different flow rates for the present engine operating conditions. If the desired number of air flow rates of the compressor has been assessed, the answer is yes and method 400 proceeds to 424. Otherwise, the answer is no and method 400 proceeds to 440.

At 424, method 400 adjusts the air flow rate through the compressor and the engine throttle position to base states or values for the present engine speed and load. The air flow through the compressor and the throttle position are adjusted back to base positions to improve engine efficiency and performance. Method 400 proceeds to exit.

At 440, method 400 adjusts the compressor flow rate via adjusting a position of the compressor flow control device. In one example, the air flow rate through the compressor may be increased in step-wise increments from a small value to a larger value. Method 400 returns to 416 after the compressor air flow rate has been adjusted.

At 430, method 400 outputs an indication of compressor degradation. The output may be a value being displayed or via a light to notify vehicle occupants. Method 400 proceeds to 432.

At 432, method 400 adjusts engine operation to reduce the possibility of further compressor degradation. In one example, engine speed and load may be limited. In other examples, a flow rate of exhaust through the turbine may be limited to limit compressor speed. The flow rate of exhaust through the turbine may be limited via adjusting a position of a waste gate or via adjusting vane positions or other turbine geometry altering devices. Method 400 proceeds to exit.

Thus, at 404-414, method 400 ensures that engine operating conditions are substantially constant (e.g., changing by less than 15%) to allow entry into steady state compressor flow adjustments. Such conditions may be useful when the compressor flow rate is adjusted in small amounts that may not be audible or noticeable to vehicle occupants.

At 450, method 400 judges if air flow through the compressor is greater than a thirteenth threshold. The air flow through the compressor may be determined via an air flow sensor or a pressure sensor. If method 400 judges that air flow through the compressor is greater than the thirteenth, the answer is yes and method 400 proceeds to 452. Otherwise, the answer is no and method 400 proceeds to 470.

At 452, method 400 judges if engine speed is greater than a fourteenth threshold. If method 400 judges that the engine speed is greater than the fourteenth threshold, the answer is yes and method 400 proceeds to 454. Otherwise, the answer is no and method 400 proceeds to 470.

Thus, at 450 and 452, method 400 restricts entry conditions into engine compressor diagnostics to more substantial transient engine conditions so that deliberate perturbations of the compressor air flow may be less noticeable to vehicle occupants.

At 470, method 400 adjusts the air flow rate through the compressor and the engine throttle position to base states or values for the present engine speed and load. The air flow through the compressor and the throttle position are adjusted back to base positions to improve engine efficiency and performance. Method 400 proceeds to exit.

At 454, method 400 adjusts flow through the compressor via a flow control device in addition to the compressor flow rate change that is due to transient engine operating conditions. For example, if transient engine operating conditions call for a compressor air flow rate of X grams/second, then the compressor air flow rate is commanded to an air flow value of X+Y grams/second. The air flow control device may be within the compressor and it adjusts flow through the compressor without recirculating air from the compressor outlet to the compressor inlet. The flow control devices may include the devices of FIGS. 2A-2C and other known compressor flow adjustment devices. The compressor air flow is adjusted while exhaust flow through the turbine may be adjusted. Method 400 proceeds to 456 after commanding an adjustment to air flowing through the compressor.

At 456, method 400 adjusts a position of an engine throttle in response to the air compressor flow diagnostic request and the amount of increase in the commanded air flow through the compressor. The throttle position is adjusted to provide the requested engine torque while air flow through the compressor is commanded to provide more air flow than is used to provide the requested engine torque at stoichiometric combustion conditions. For example, if the compressor flow rate is increased by X+Y grams/second, the throttle may be partially closed to maintain engine air flow at X grams/second (e.g., engine air flow to provide the desired engine torque). The throttle position may be adjusted responsive to the pressure ratio across the throttle. Method 400 proceeds to 458.

At 458, method 400 judges if air flow through the compressor is greater than a fifteenth threshold and less than a sixteenth threshold. The air flow through the compressor may be determined via an air flow sensor or a pressure sensor. If method 400 judges that air flow through the compressor is greater than a fifteenth threshold and less than a sixteenth threshold, the answer is yes and method 400 proceeds to 460. Otherwise, the answer is no and method 400 proceeds to 480.

At 460, method 400 adjusts the air flow rate through the compressor and the engine throttle position to base states or values for the present engine speed and load after the transition in engine operating conditions. The air flow through the compressor and the throttle position are adjusted back to base positions to improve engine efficiency and performance. Method 400 proceeds to exit.

At 480, method 400 outputs an indication of compressor degradation. The output may be a value being displayed or via a light to notify vehicle occupants. Method 400 proceeds to 482.

At 482, method 400 adjusts engine operation to reduce the possibility of further compressor degradation. In one example, engine speed and load may be limited. In other examples, a flow rate of exhaust through the turbine may be limited to limit compressor speed. The flow rate of exhaust through the turbine may be limited via adjusting a position of a waste gate or via adjusting vane positions or other turbine geometry altering devices. Method 400 proceeds to exit.

In this way, air flow through a compressor may be purposefully disturbed and diagnosed during substantially steady state conditions or transient engine operating conditions so that vehicle occupants may be unaware of the ongoing diagnosis.

Thus, the method of FIGS. 4A-4C provides for an engine operating method, comprising: adjusting air flowing through a compressor and into an engine without recirculating at least a portion of the air flowing through the compressor from an outlet of the compressor to an inlet of the compressor in response to a request to diagnose flow through and pressure over the compressor, the air flowing through the compressor adjusted via a flow control device in an air flow path of the engine. The method includes where adjusting air flowing through the compressor includes increasing air flow through the compressor in a step-wise manner in response to the request to diagnose flow through the compressor, and where pressure over the compressor is a pressure change from an inlet of the compressor to an outlet of the compressor. The method further comprises adjusting air flowing through the compressor in further response to engine air flow being greater than a first threshold and less than a second threshold.

In some examples, the method further comprises comparing a flow rate of air flowing through the compressor to a threshold and indicating compressor degradation in response to the flow rate being less than the threshold. The method includes where the flow rate through the compressor is based on output of a mass air flow sensor. The method includes where the flow rate through the compressor is based on a pressure in an engine air intake passage. The method includes where the device in the air flow path is a vane. The method includes where the device in the air flow path is an air flow control sleeve. The method includes where the device in the air flow path is a compressor casing flow control valve.

The method of FIGS. 4A-4C also provides for an engine operating method, comprising: adjusting air flowing through a compressor via a flow control device in an engine air intake air flow path and into an engine in response to a request to diagnose flow through the compressor; and adjusting a position of a throttle in response to adjusting air flow through the compressor to maintain a substantially constant engine air flow rate. The method includes where adjusting air flowing through the compressor includes increasing air flow through the compressor, where adjusting a position of the throttle includes at least partially closing the throttle, and where adjusting air flowing through the compressor includes not recirculating air from an outlet of the compressor to an inlet of the compressor. However, in some examples, the air flow may be adjusted with recirculating air from the compressor outlet to the compressor inlet.

In some examples, the method further comprises comparing air flowing through the compressor after adjusting air flowing through the compressor in response to the request to diagnose flow through the compressor to a threshold value. The method further comprises indicating compressor degradation in response to air flowing through the compressor after adjusting air flowing through the compressor being less than the threshold value. The method includes where the compressor is included in a turbocharger.

Note that the example control and estimation routines included herein can be used with various engine and/or vehicle system configurations. The control methods and routines disclosed herein may be stored as executable instructions in non-transitory memory and may be carried out by the control system including the controller in combination with the various sensors, actuators, and other engine hardware. The specific routines described herein may represent one or more of any number of processing strategies such as event-driven, interrupt-driven, multi-tasking, multi-threading, and the like. As such, various actions, operations, and/or functions illustrated may be performed in the sequence illustrated, in parallel, or in some cases omitted. Likewise, the order of processing is not necessarily required to achieve the features and advantages of the example embodiments described herein, but is provided for ease of illustration and description. One or more of the illustrated actions, operations and/or functions may be repeatedly performed depending on the particular strategy being used. Further, the described actions, operations and/or functions may graphically represent code to be programmed into non-transitory memory of the computer readable storage medium in the engine control system, where the described actions are carried out by executing the instructions in a system including the various engine hardware components in combination with the electronic controller.

This concludes the description. The reading of it by those skilled in the art would bring to mind many alterations and modifications without departing from the spirit and the scope of the description. For example, 13, 14, 15, V6, V8, V10, and V12 engines operating in natural gas, gasoline, diesel, or alternative fuel configurations could use the present description to advantage.

The invention claimed is:

1. An engine operating method, comprising:

adjusting air flowing through a compressor and into an engine without recirculating air from an outlet of the compressor to an inlet of the compressor in response to a request to diagnose flow through and pressure over the compressor, the air flowing through the compressor adjusted via a flow control device in an air flow path of the engine, where the flow control device in the air flow path is one of a vane, a flow control sleeve, or a compressor casing flow control valve.

2. The method of claim 1, where adjusting air flowing through the compressor includes increasing air flow through the compressor in a step-wise manner in response to the request to diagnose flow through the compressor, and where pressure over the compressor is a pressure change from an inlet of the compressor to an outlet of the compressor.

3. The method of claim 1, further comprising adjusting the air flowing through the compressor in further response to engine air flow being greater than a first threshold and less than a second threshold.

4. The method of claim 1, further comprising comparing a flow rate of air flowing through the compressor to a threshold and indicating compressor degradation in response to the flow rate being less than the threshold.

5. The method of claim 4, where the flow rate through the compressor is based on output of a mass air flow sensor.

6. The method of claim 4, where the flow rate through the compressor is based on a pressure in an engine air intake passage.

7. An engine operating method, comprising:

adjusting air flowing through a compressor via a flow control device in an engine intake air flow path and into an engine in response to a request to diagnose flow through the compressor; and adjusting a position of a throttle in response to adjusting air flow through the compressor to maintain a substantially constant engine air flow rate.

8. The method of claim 7, where adjusting air flowing through the compressor includes increasing air flow through the compressor, where adjusting a position of the throttle includes at least partially closing the throttle, and where adjusting air flowing through the compressor includes not recirculating air from an outlet of the compressor to an inlet of the compressor.

9. The method of claim 7, further comprising comparing air flowing through the compressor after adjusting air flowing through the compressor in response to the request to diagnose flow through the compressor to a threshold value.

10. The method of claim 9, further comprising indicating compressor degradation in response to air flowing through the compressor after adjusting air flowing through the compressor being less than the threshold value.

11. The method of claim 7, where the compressor is included in a turbocharger.

12. A system, comprising:

an engine;

a turbocharger coupled to the engine and including a compressor, a turbine, and an air flow control device within a compressor housing;

a controller including instructions stored in non-transitory memory to adjust the air flow control device in response to a request to diagnose air flow through the compressor without recirculating air from a compressor outlet to a compressor inlet.

13. The system of claim 12, where the air flow control device is a vane, and further comprising additional instructions to adjust the air flow control device in further response to change in engine air flow greater than a threshold.

14. The system of claim 12, where the air flow control device is an air flow control sleeve, and further comprising additional instructions to adjust the air flow control device in response to a change in engine speed greater than a threshold.

15. The system of claim 12, where the air flow control device is a compressor casing flow control valve, and further comprising additional instructions to adjust the air flow control device in response to engine speed greater than a first threshold and engine speed less than a second threshold.

16. The system of claim 12, further comprising a throttle located in an air passage of the engine at a location downstream of the compressor.

17. The system of claim 16, further comprising instructions to adjust a position of throttle responsive to the request to diagnose air flow through the compressor.

* * * * *